United States Patent [19]

Larsen et al.

[11] 4,372,502

[45] Feb. 8, 1983

[54] ADJUSTABLE THREAD TENSIONING DEVICE FOR A SEWING MACHINE

[75] Inventors: Robert H. Larsen, Middletown, N.J.; Anthony Giaimo, Staten Island, N.Y.

[73] Assignee: The Singer Company, Stamford, Conn.

[21] Appl. No.: 246,531

[22] Filed: Mar. 23, 1981

[51] Int. Cl.[3] ..... D05B 47/02; B65H 59/22

[52] U.S. Cl. ..... 242/149; 112/254

[58] Field of Search ..... 112/59, 97, 254, 255; 66/146; 242/149

[56] References Cited

U.S. PATENT DOCUMENTS

| | | | |
|---|---|---|---|
| 119,589 | 10/1871 | Estabrooke | 112/254 |
| 314,635 | 3/1885 | Whitney | 112/255 X |
| 319,744 | 6/1885 | Pentz | 112/254 |
| 332,754 | 12/1885 | Rossiter | 112/255 |
| 545,682 | 9/1895 | Coram | 242/149 |
| 553,347 | 1/1896 | LaRue | 112/254 X |
| 642,698 | 2/1900 | Iveson | 242/149 |
| 1,682,796 | 9/1928 | Olson | 242/149 |
| 2,609,772 | 9/1952 | Casas-Robert | 112/254 |
| 2,733,025 | 1/1956 | Sporney | 242/150 R |
| 2,760,458 | 8/1956 | Ayres | 112/254 |
| 2,896,561 | 7/1959 | Ashworth | 112/59 X |
| 3,366,083 | 1/1968 | Ketterer et al. | 112/254 |
| 3,557,731 | 1/1971 | Casas-Robert | 112/254 |
| 3,667,414 | 6/1972 | Illes et al. | 112/254 |
| 3,927,631 | 12/1975 | Kuhar | 112/254 |
| 3,970,019 | 7/1976 | Coulombe et al. | 112/254 X |
| 4,111,140 | 9/1978 | Gonnai et al. | 112/254 |
| 4,141,306 | 2/1979 | Weber | 112/254 |
| 4,180,006 | 12/1979 | Ross | 112/254 |
| 4,246,857 | 1/1981 | Gonnai et al. | 112/254 |

*Primary Examiner*—Wm. Carter Reynolds

*Attorney, Agent, or Firm*—William V. Ebs; Robert E. Smith; Edward L. Bell

[57] ABSTRACT

A thread tensioning device for a sewing machine is provided with a rigid beam which pivots on an adjustable fulcrum in engagement with a mounting plate. The device includes an adjustable tension selector movable along the plate and beam for varying the tension on needle thread disposed between the plate and beam.

6 Claims, 5 Drawing Figures

ADJUSTABLE THREAD TENSIONING DEVICE FOR A SEWING MACHINE

BACKGROUND OF THE INVENTION

1. Field of the Invention

The invention relates to thread tensioning devices in general, and more particularly, to adjustable thread tensioning devices having particular application on sewing machines for controlling the tension in needle thread.

2. Description of the Prior Art

Adjustable thread tensioning devices for use in controlling the tension in needle thread on a sewing machine are well known. Such devices generally include a plurality of discs which apply friction to thread extending between them. The discs are spring biased toward one another and the spring tension is adjustable by mechanism which an operator controls by adjusting a dial or the like. Examples of such devices are disclosed in U.S. Pat. No. 3,667,414 issued June 6, 1972, U.S. Pat. No. 4,141,306 issued Feb. 27, 1979, and U.S. Pat. No. 4,180,006 issued Dec. 25, 1979, all of which are assigned to the same assignee as the present application. The prior art devices of this type are complex in construction, difficult to assemble and costly to produce, both because of use of the multiple tension applying discs, and the arrangements employed to effect initial adjustments in these devices as at the time of their installation on a sewing machine.

It is a prime object of this invention to provide an improved needle thread tensioning device which is simple in construction, easy to assemble, inexpensive to produce, and convenient to initially adjust as required to provide the control range desired for the device.

Other objects and advantages of the invention will become apparent during a reading of the specification taken in conjunction with the accompanying drawings.

SUMMARY OF THE INVENTION

In accordance with the invention there is provided a thread tensioning device including a base plate which mounts on a sewing machine, and a rigid beam that can pivot about an axis defined by a fulcrum having a fixed longitudinal position along the plate and beam to control frictional force on thread disposed between the beam and plate. A movable tension selector is mounted for sliding motion on the base plate. The selector includes a member movable along the beam as the selector moves on the base plate, and a spring to forceably urge said member against the beam and cause frictional force to be applied to the thread in accordance with the position of the selector. Means for adjusting the spring enable a machine operator to preset tension in the thread at a defined position of the selector along the base plate. By adjusting the fulcrum to raise or lower the beam at its pivotal axis relative to the plate, the operator may preset thread tension at another defined position of the selector to establish the range of thread tension control between the said defined positions.

DESCRIPTION OF THE PREFERRED EMBODIMENT

Figure 1:
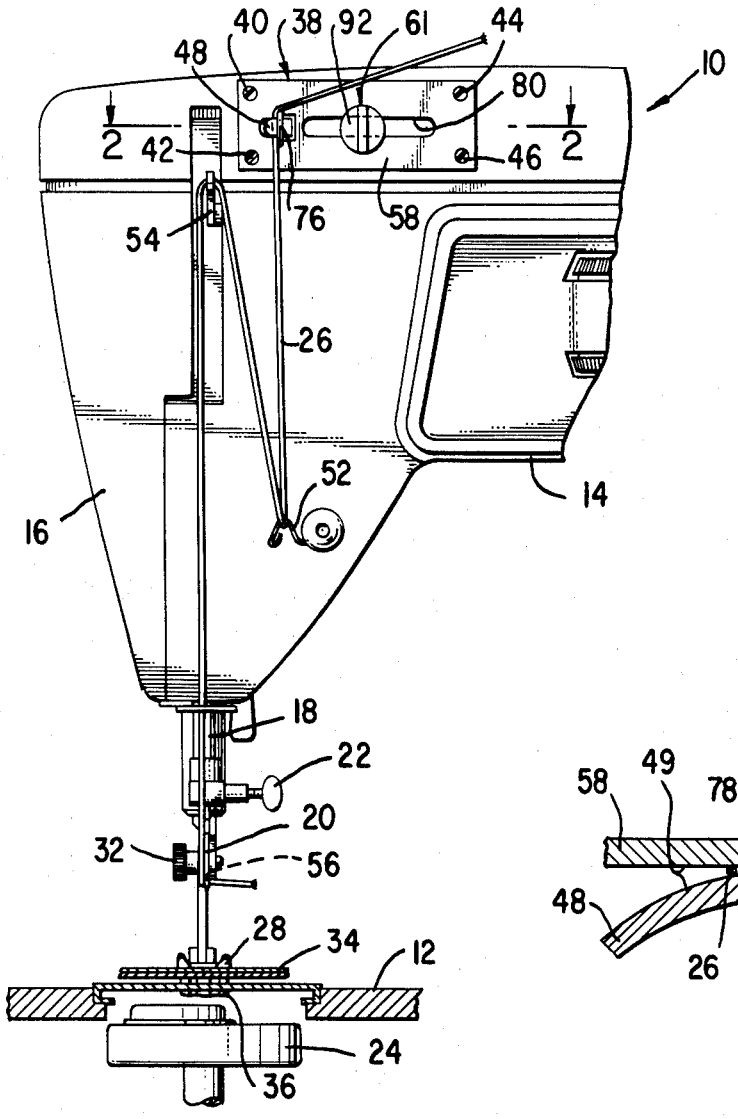
FIG. 1 is a front elevational view of a head end portion of a sewing machine including the needle thread tensioning device of the invention.

Referring to FIG. 1 of the drawings reference character 10 designates a portion of a sewing machine including a work supporting bed 12, a bracket arm 14, and a sewing head 16. A needle bar 18 is carried in the sewing head for endwise reciprocation, and a sewing needle 20 is carried in the lower end portion of the needle bar where it is secured by a screw 22. The sewing needle 20 cooperates with a rotary looptaker 24 journalled in the bed and driven in timed relationship to the arm shaft in a well known manner for concatenating needle thread 26 to form lockstitches with bobbin thread (not shown). A presser foot 28 secured to a presser bar 30 by screw 32 serves to urge work 34 into contact with a feed dog 36 by means of which work is advanced under the needle 20.

Reference character 38 designates a needle thread tensioning device in accordance with the invention. As shown, the tensioning device is secured at 40, 42, 44 and 46 to the sewing machine frame. The tensioning device receives needle thread 26 under a tongue 48 from a supply spool (not shown). As indicated, the thread extends from tongue 48 to a check spring 52 and then to a takeup 54. From the takeup the thread extends to the needle 20 where it passes through needle eye 56.

Figure 3:
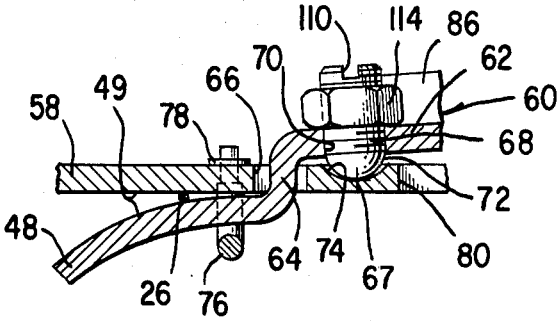
FIG. 3 is an enlarged sectional view of a portion of the device as shown in FIG. 2.
Figure 2:
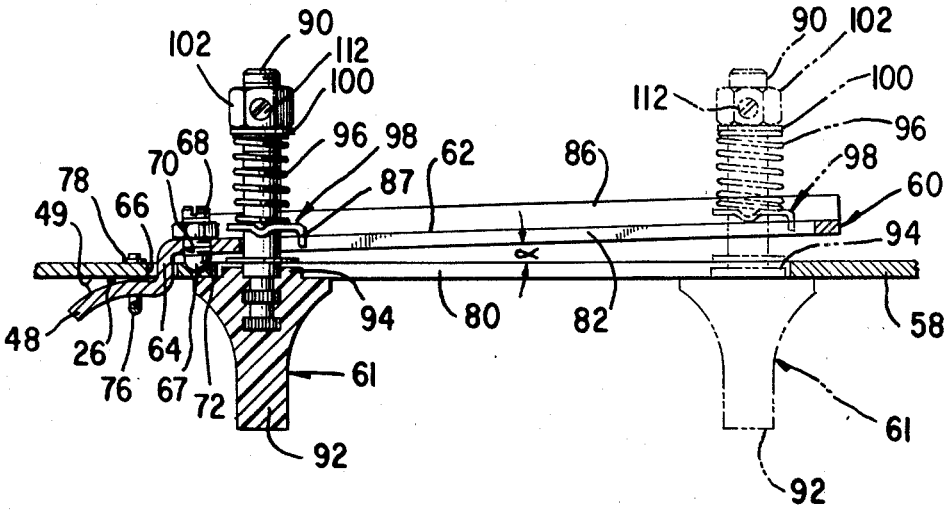
FIG. 2 is an enlarged sectional view taken on the plane of the line 2—2 of FIG. 1.
Figure 4:
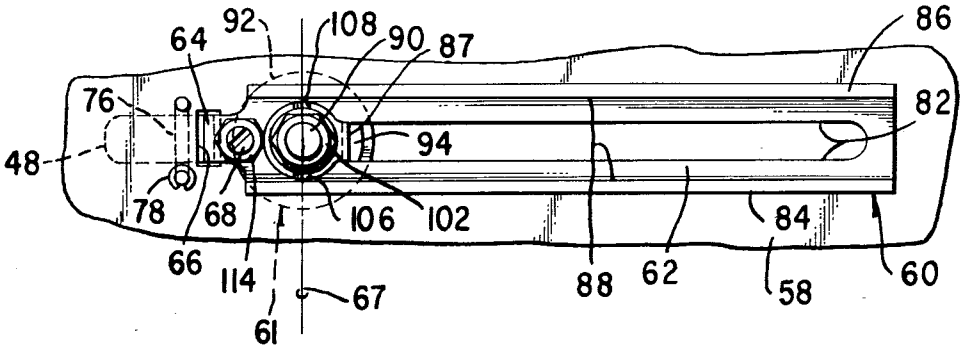
FIG. 4 is an enlarged bottom view of the tensioning device.
Figure 5:
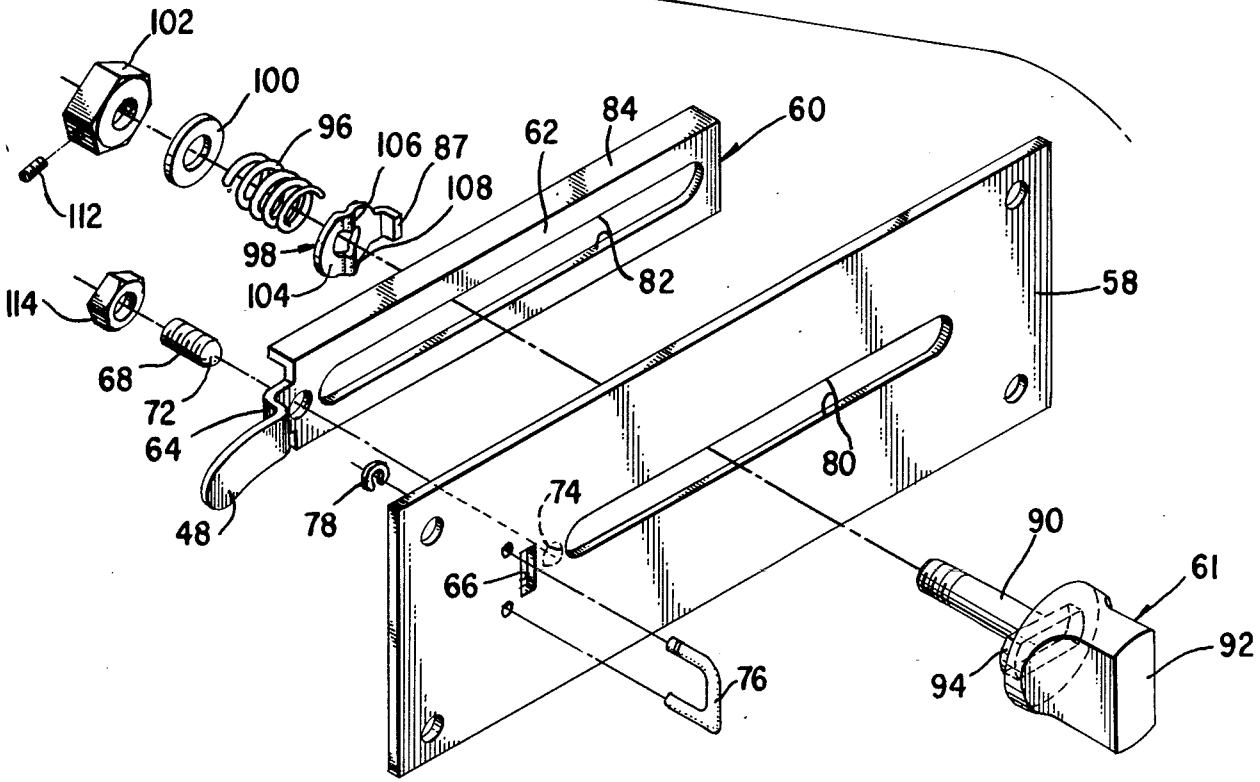
FIG. 5 is an enlarged exploded perspective view of the device.

As may be seen in FIGS. 2, 3 and 4, the tensioning device includes a base plate 58 which serves as a mounting plate for the device on the machine. The tensioning device further includes a rigid beam 60 mounted for pivotal movement on the plate, and a thread tension selector 61 movable along the plate and beam for controlling frictional force on the thread 26 under tongue 48. One portion of the beam 60 defines the tongue 48 on one side of the plate where it forms thread receiving gap 49 with plate 58. Another portion 62 of the beam extends along the other side of the plate from the tongue, and a connecting portion 64 between the tongue 48 and beam portion 62 extends through a opening 66 in plate 58. The pivotal axis 67 of the beam is defined by a fulcrum 68 having a threaded connection at 70 with beam 60and in engagement on a rounded end portion 72 with plate 58 in a plate recess 74. The tongue 48 is laterally confined by a bridging strap 76 secured in the base plate by snap washer 78.

Base plate 58 is formed with a longitudinally extending slot 80, and portion 62 of beam 60 is formed with a central longitudinally extending slot 82 that aligns with the slot in the base plate. As shown, the beam 60 includes side flanges 84 and 86 which define a channel 88. A threaded shaft 90 of tension selector 61 extends through the base plate and beam slots 80 and 82. A knob 92 for use in moving the tension selector along the base plate 58 and beam 60 is affixed to one end of the shaft on the side of the base plate opposite from the side where beam portion 62 is located. The underside of the knob is formed with a protuberance 94 to extend into plate slot 80 and serve as a guide for the knob. The knob is held against the base plate 58 with the protuberance 94 in slot 80 by a compression spring 96 which is located on the threaded shaft between a member 98 for applying a force to the beam 60 and a washer 100 held on the shaft by a nut 102. Member 98 includes a shaft encircling portion 104 with diametrically opposite ribs 106 and 108 having transverse line contact with the beam 60 between flanges 84 and 86, and includes a depending tang 87 which extends through beam slot 82 to prevent angular movement of the member on shaft 90. The spring 96 can be compressed or relaxed by turning the nut 102 to cause ribs 106 and 108 on member 98 to bear against the beam 60 with more of less force.

As noted hereinbefore, a fulcrum 68 for the beam 60 has a threaded connection at 70 with the beam. Such threaded connection constitutes means by which the beam may be raised or lowered at the fulcrum as the fulcurm is turned with a screw driver in slot 110. Adjustment of the fulcrum with thread 26 in gap 49 angularly displaces the beam 60 with respect to plate 58, and has a substantial effect upon the compression of spring 96 if made while the tension selector is in a position remote from the fulcrum, but has little effect while the tension selector is close to the fulcrum. It is therefor possible to establish a desired control range for the tensioning device 38 by first disposing tension selector 61 with knob 92 along plate 58 and beam 60 in close proximity to the fulcrum (solid line position of tension selector in FIG. 2), and then adjusting nut 102 to preselect a minimum thread tensioning force. The nut is secured in its adjusted position with lockscrew 112, and the tensioning device is moved near the far right hand end of the plate (dotted line position of tensioning device in FIG. 2). In such position of the tensioning device remote from the fulcrum, the fulcrum is adjusted to increase the angle $\alpha$ between the beam 60 and plate 58 until the spring 96 is compressed sufficiently to result in a desired maximum thread tension. The fulcrum is then locked in its adjusted position by tightening a nut 114 on the fulcrum against beam 60.

Thread tension for sewing operations is increased within the established control range by moving the tension selector away from the fulcrum to increase the effective lever arm of the beam extending from axis 67 to the line of contact between force applying ribs 106 and 108 of member 98 and beam 60. Movement of the tension device in the opposite direction decreases such effective lever arm and thread tension. The manner in which thread tension is varied with movement of the tension selector along the plate 58 and beam 60, that is whether the relationship is linerally varying or otherwise may be readily predetermined with a suitably designed contour for beam 60.

It will be understood from the above detailed description that a new and improved thread tensioning device which is simple in construction and inexpensive to produce is provided. It will also be apparent to those skilled in the art that various changes and modifications may be made in the described structure without departing from the spirit and scope of the invention. A possible modification, for example, would be to provide thread receiving plates between a plate and pivoted beam at a location remote from the beam axis, and to have an adjustable tension selector as described movable along the beam between the pivotal axis of the beam and the plates for controlling tension on thread disposed between the plates. Such device could be provided with an adjustable fulcrum for the purposes hereinbefore described.

We claim:

1. A thread tensioning device comprising a base plate with an opening therethrough; a rigid beam including a portion on one side of the plate defining a thread receiving gap with the plate, another portion on the other side of the plate, and a connecting portion extending through the plate opening; a fulcrum mounting the beam between the ends thereof for pivotal movement about an axis which is substantially fixed longitudinally along the base plate and beam; and a tension selector mounted for sliding motion on the base plate, the selector including a member movable along said another portion of the beam as the selector moves on the base plate, an adjustable spring for forcibly urging said member against the beam to cause frictional force to be applied to thread in said gap in accordance with the position of the selector and adjustment of the spring, and means for adjusting the spring to preset tension in the thread at a defined position of the selector along the base plate.

2. A thread tensioning device according to claim 1 wherein the pivotal axis is on said another side of the beam.

3. A thread tensioning device according to claim 1 including means for adjusting the fulcrum to raise and lower the beam relative to the base plate at the pivotal axis of the beam to preset tension in the thread at another defined position of the selector along the base plate.

4. A thread tensioning device according to claim 3 wherein the fulcrum is a pin with a rounded head which engages a curved seat in the plate and the fulcrum adjusting means is a threaded connection between the beam and fulcrum.

5. A thread tensioning device according to claim 4 including a strap secured to the plate and extending across said one portion of the beam for restricting lateral motion of the beam.

6. A thread tensioning device according to claim 1 including a knob on the tension selector for use in selectively locating the selector along the base plate.

* * * * *